United States Patent [19]

Morehead

[11] Patent Number: 5,024,258

[45] Date of Patent: Jun. 18, 1991

[54] WALLET

[76] Inventor: William C. Morehead, 10341 Southwind Dr., Cincinnati, Ohio 45242

[21] Appl. No.: 489,964

[22] Filed: Mar. 6, 1990

Related U.S. Application Data

[63] Continuation-in-part of Ser. No. 409,007, Sep. 18, 1989, abandoned.

[51] Int. Cl.[5] ..... A45C 1/06; A45C 11/18

[52] U.S. Cl. ..... 150/140; 150/146; 150/147

[58] Field of Search ..... 150/131, 132, 136, 140, 150/141, 147, 148, 149, 146; D3/56, 100, 60

[56] References Cited

U.S. PATENT DOCUMENTS

| | | | |
|---|---|---|---|
| 601,922 | 4/1898 | Wieland | 150/132 |
| 1,635,940 | 7/1927 | Kanzel | 150/132 X |
| 1,761,976 | 6/1930 | Barnes | 150/141 |
| 1,772,891 | 8/1930 | Gardner, Jr. | 150/132 |
| 2,266,128 | 12/1941 | Stanley | 150/132 |
| 2,277,103 | 3/1942 | Herbener | 150/141 |
| 2,397,366 | 3/1946 | Ogden | 150/140 |
| 2,881,818 | 4/1959 | Lathrop | 150/140 |
| 3,048,210 | 8/1962 | Fook | 150/141 |
| 3,360,027 | 12/1967 | Price | 150/132 |
| 4,209,048 | 6/1980 | Sandos | 150/132 |

FOREIGN PATENT DOCUMENTS

| | | | |
|---|---|---|---|
| 875944 | 10/1942 | France | 150/136 |
| 234386 | 5/1925 | United Kingdom | 150/136 |

*Primary Examiner*—Sue A. Weaver

*Attorney, Agent, or Firm*—Reising, Ethington, Barnard, Perry & Milton

[57] ABSTRACT

A wallet (10) suitable for front pocket storage having a plurality of square sheets (14) and binding (26) along two adjoining edges (16, 18). The pockets (24) have two edges (20, 22) open or unbound. Currency and cards (12) may be organized in the individual pockets (24). The plurality of square sheets (14) and binding (26) are made of pliable or flexible material so that the wallet (10) may easily fit within a man's front pant pocket.

6 Claims, 1 Drawing Sheet

WALLET

This is a continuation-in-part of application Ser. No. 409,007, filed on Sept. 18, 1989, now abandoned.

TECHNICAL FIELD

This invention relates to pocket wallets, and more particularly, to wallets used to store materials in the front pocket of a pair of pants.

BACKGROUND ART

It is well known that people carry their money, credit cards, driver license, and other means for identification in a wallet. Many of these people, mainly men, carry their wallets in the back pockets of their pants. This is undesirable for several reasons. First, it is uncomfortable to sit on a wallet. Second, the wallet produces wear marks in the pants from the extra friction imparted during the act of sitting or standing. And third, it is much easier for someone to steal a wallet out of the back pocket than it is to steal a wallet out of a front pocket. For these reasons, attempts have been made at designing a wallet that is suitable for storage in the front pocket. U.S. Pat. No. 3,360,027 to Price, describes a money and ticket holder. This holder allows the user to store money and tickets, particularly, dog racing tickets, separately.

U.S. Pat. No. 2,881,818 to Lathrup discloses a wallet comprising two rectangular panels which are interconnected along hinge line and by stitching. This wallet provides only two compartments and two unidentified compartments having three bound sides. U.S. Pat. No. 2,397,366 to Odgen discloses a bill fold comprising a plurality of rectangular leaves of unequal sizes bound together along two edges. For this wallet to be stored in the front pocket of a pair of pants, it must be folded in half, thus increasing the thickness of the wallet. U.S. Pat. No. 1,761,976 to Barnes also discloses a wallet comprising rectangular sheets which must be folded to be placed in the front pocket.

These designs are lacking in that the user can not quickly pull the any of these wallets out of his pocket and pull out the desired items. He must pull out the holder, search for the proper opening, in some designs, unfold the wallet these motions consisting of flipping and rotating the holder. These acts create a rather large window of opportunity for a thief to grab the holder full of money bills and credit cards.

A thin wallet having uniform pockets which allows for a quick access is needed. No where is there shown a wallet used to store items such as money or credit cards that allows for quick access to prevent someone from viewing what the user has or for stealing from the user.

SUMMARY OF THE INVENTION AND ADVANTAGES

A wallet for storing materials such as credit cards, money bills, and the like is disclosed. The wallet comprises a plurality of square sheets stacked one upon the other. These square sheets have equal areas and the peripheries of which are coextensive defining four equal edges. The wallet is characterized by binding means for binding the first two adjacent and perpendicular edges of the plurality of the square sheets. This provides a square wallet having open pockets defined by the remaining adjacent and perpendicular edges. These open pockets receive materials to be stored therein.

The subject invention reduces the risk of theft by allowing the user to store the subject wallet in his front pant pocket. In addition, the wallet's configuration allows the user to retrieve items from the wallet more readily. In other words, the thief's window of opportunity to steal the wallet while the user is retrieving items from the wallet is greatly reduced. Also, since the wallet does not have to be folded to be inserted in the front pocket of the pants, the wallet does not create any unsightly bulges or increase the wear of the pants due to the constant deformation of shape of pants.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
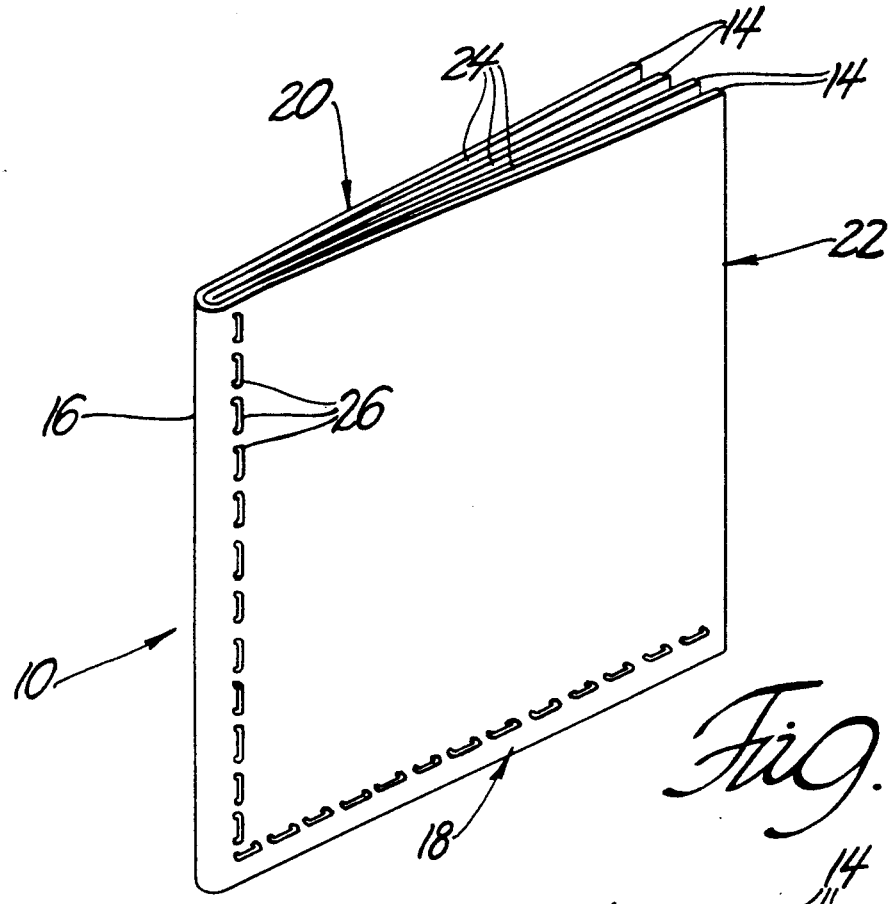
FIG. 1 is a perspective view of a wallet constructed in accordance with the subject invention.
Figure 2:
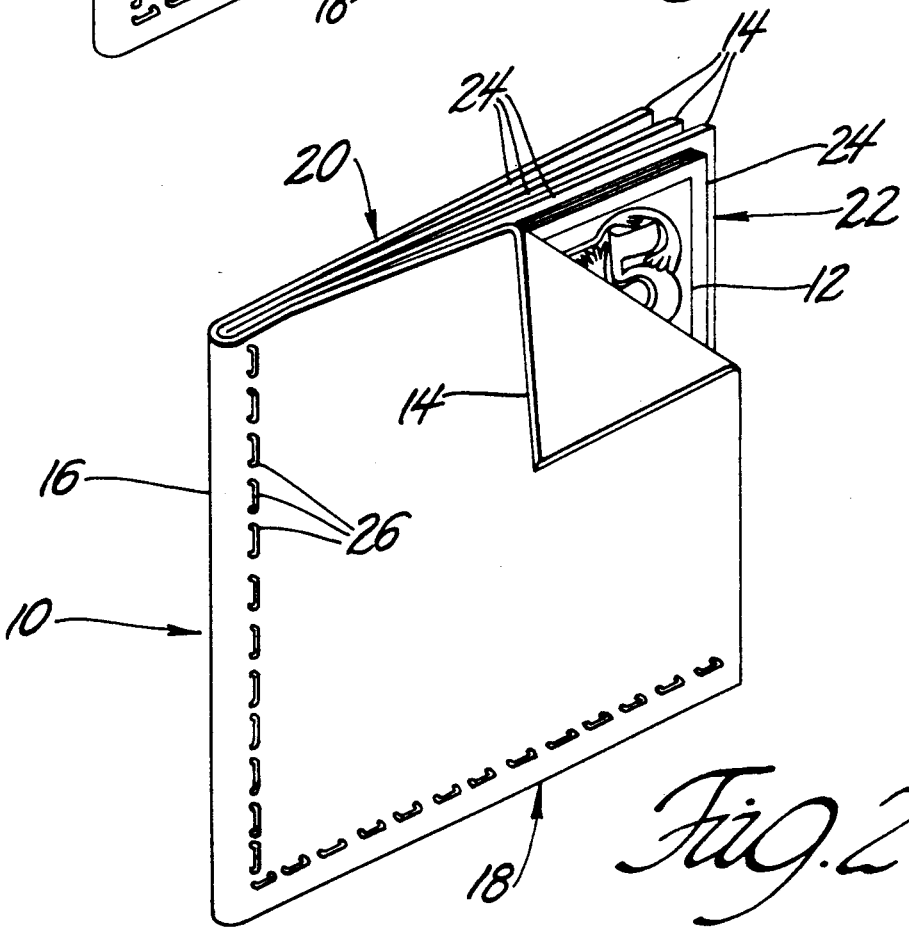
FIG. 2 is a perspective drawing of the wallet with a corner of one sheet pulled away showing the contents of one pocket.

As shown in FIGS. 1 and 2, a wallet for storing materials such as credit cards (not shown), money bills 12, and the like is generally shown at 10. The wallet 10 comprises a plurality of square sheets 14 stacked one upon the other, all of which have equal areas and coextensive peripheries defining four equal edges 16, 18, 20, 22. In other words, the square sheets 14 of the wallet 10 are of equal size and are perfectly aligned with one another. The wallet 10 is characterized by binding means 26 which is used for binding a first two adjacent and perpendicular edges 16, 18 of the plurality of the square sheets 14 for providing a square wallet 10 with open pockets 24 defined by the remaining two adjacent and perpendicular edges 20, 22. These open pockets 24 receive the materials 12 to be stored therein. An important feature of the wallet 10 is that a pocket 24 is created between every two square sheets 14 and all of the pockets 24 have two adjacent and perpendicular unbound edges 20, 22. This maximizes the number of pockets 24 with respect to thickness of the wallet 10.

In the preferred embodiment, the wallet 10 comprises two the square sheets 14 being integral with one another. These two square sheets 14 extend through a fold along one of the bound edges 16. In other words, as an alternative form of manufacturing a wallet 10, the two outermost square sheets 14 may comprise one rectangular sheet whose length is twice its width thus allowing the rectangular sheet to be folded in half to effectuate two square sheets 14.

Because one of the major advantages of the wallet 10 is its ability to be stored in the front pocket of a pair of pants, it is imperative that the square sheets 14 be fabricated of a pliable material. This pliable material must be sturdy enough to hold the materials 12 stored within the open pockets 24 of the wallet 10, and yet pliable or bendable enough to conform to the shape of the thigh to provide the comfort and aesthetics desired. Said another way, the material used to create the square sheets 14 must to able to bend so the wallet 10 may be placed in the user's pocket in a conspicuous and unobtrusive manner and, at the same time, increase the user's ability to quickly retrieve the material 12 out of the wallet 10.

The binding means 26 used to bind the square sheets 14 together must also be fabricated of a pliable material. It is apparent that if the material used to fabricate the square sheets 14 is pliable, then the binding means 26 must also be pliable or bendable.

The square sheets 14 of the wallet 10 may be comprised of any pliable material, such as leather, plastic, vinyl, and the like. The binding means 26 may be comprised of a suitable binding for the materials used to comprise a plurality of square sheets 14, such as adhesive, nylon or cloth thread. In the preferred embodiment, the binding means 26 comprises a nylon thread stitching 26.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A wallet (10) for storing materials such as credit cards and money bills (12), said wallet (10) comprising:

a plurality of square sheets (14) stacked one upon the other; said sheets (14) having equal areas and coextensive peripheries defining first and second pairs of adjacent and perpendicular edges (16, 18 and 20, 22) of equal length, said wallet (10) characterized by binding means (26) for binding said first pair of adjacent and perpendicular edges (16, 18) of all of said plurality of square sheets (14) for providing said square wallet (10) with open pockets (24) defined only by said second pair of adjacent and perpendicular edges (20, 22) for receiving materials (12) to be stored between every two of said square sheets (14).

2. A wallet (10) as set forth in claim 1 further characterized by two of said square sheets (14) being integral and extending through a fold along one of said bound edges (16).

3. A wallet (10) as described in claim 2 further characterized by said plurality of square sheets (14) being fabricated of a pliable material.

4. An assembly as set forth in claim 3 further characterized by said binding means (26) being fabricated of a pliable material.

5. An assembly as set forth in claim 4 further characterized by said binding means (26) including stitching (26).

6. An assembly as set forth in claim 5 further characterized by said stitching (26) being fabricated of nylon thread.

* * * * *